US005586887A

United States Patent [19]

McNelis et al.

[11] Patent Number: 5,586,887

[45] Date of Patent: Dec. 24, 1996

[54] HOWITZER STRAP-ON KIT FOR CREW PERFORMANCE EVALUATION AND TRAINING METHOD

[75] Inventors: Niall B. McNelis, Baltimore; Richard W. Doyle, Fallston; Dale A. Clark, Parkton; Larry A. Zeafla, Baltimore; Thomas P. McGrath, Lutherville, all of Md.

[73] Assignee: AAI Corporation, Hunt Valley, Md.

[21] Appl. No.: 346,289

[22] Filed: Nov. 23, 1994

[51] Int. Cl.[6] ..... F41G 3/26

[52] U.S. Cl. ..... 434/20; 434/19; 434/11; 89/41.17

[58] Field of Search ..... 434/11, 16, 19, 434/20, 21, 27, 25, 26, 14, 12, 13; 89/41.06, 41.17, 41.19

[56] References Cited

U.S. PATENT DOCUMENTS

| | | | |
|---|---|---|---|
| H613 | 4/1989 | Stello et al. | 434/19 |
| 3,766,826 | 10/1973 | Salomonsson | 89/41.06 |
| 3,798,795 | 3/1974 | Michelsen | 434/19 |
| 4,521,196 | 6/1985 | Briard et al. | 434/20 |
| 4,606,724 | 8/1986 | Chanforan et al. | 434/20 |
| 4,789,339 | 12/1988 | Bagnall-Wild et al. | 434/20 |
| 4,993,819 | 2/1991 | Moorhouse | 434/20 X |

FOREIGN PATENT DOCUMENTS

| | | | |
|---|---|---|---|
| 2141810 | 1/1985 | United Kingdom | 434/20 |

*Primary Examiner*—Gene Mancene
*Assistant Examiner*—Jeffrey A. Smith
*Attorney, Agent, or Firm*—Griffin, Butler Whisenhunt & Kurtossy

[57] ABSTRACT

A training apparatus, method and kit for remotely and substantially instantaneously evaluating the alignment, settings and levels of the aiming devices of a howitzer gun. The apparatus includes a video camera for manually removably attaching to the pantel and receiving the sight picture in the pantel or displaying a sight picture in a pantel eyepiece, a pantel deflection setting encoder for manually removably attaching to a pantel deflection setting device and encoding signals responsive to the pantel deflection setting, a pantel level encoder for manually removably attaching to the pantel and encoding signals responsive to the pantel level, a quadrant setting encoder for manually removably attaching to the quadrant setting device and encoding a signal responsive to the quadrant setting, a quadrant level encoder for manually removably attaching to the quadrant and encoding signals responsive to a quadrant level, and a data processing computer for receiving and analyzing the sight picture, or displaying or controlling a synthetic sight picture in a pantel eyepiece, for receiving the signals and for evaluation of the alignment, settings and levels.

22 Claims, 6 Drawing Sheets

HOWITZER STRAP-ON KIT FOR CREW PERFORMANCE EVALUATION AND TRAINING METHOD

The present invention relates to a training apparatus suitable for manually removably attaching to a howitzer gun or trainer version thereof for determining the aim of the gun or trainer in evaluating the performance of a crew in training.

BACKGROUND OF THE INVENTION

The howitzer-type gun is the central piece of artillery used in military batteries throughout the world. This gun can be fired with great accuracy and at long ranges if the gun is correctly aimed. However, the correct aiming of the gun by a gun operating crew requires substantial and extended training of that crew, not only for accuracy of aiming the gun, but for the rapidity at which that aiming can take place.

As can be appreciated, in a training exercise, an instructor could visually evaluate each of the aiming settings, as those settings are made, but this would require an interruption of the crew's aiming exercise while observations of a particular setting and subsequent settings are made. This would destroy the rapidity aspect of proper training and not simulate combat conditions.

To avoid such interruption of the crew in training, for some time the art has provided a series of howitzer instrumenting apparatus which is embedded into the sighting devices of the howitzer in a more or less permanent fashion, i.e. it is time consuming and difficult to attach and detach that apparatus. That embedded apparatus is capable of determining the settings and other parameters made by a training crew and substantially instantaneously conveying that information to the instructor for evaluation purposes.

However, as can be easily appreciated, since those prior art devices were substantially embedded in the howitzer gun sighting devices so as to modify a particular gun for training purposes or in the sighting devices of a simulated gun, i.e. a trainer, and since for economy a limited number of howitzers can be justifiably so modified or trainers constructed, a substantial problems existed in either transporting a crew for training to such modified gun or trainer or transporting such modified gun or trainer to a crew for training. This is particularly true when the training of the crew is in the field, and, therefore, it is necessary to transport such modified gun or trainer from one training field location to another training field location. This not only severely limits the time available for training on the modified gun or trainer, but the cost of transporting the crew/gun/trainer is substantial. Further, the cost of so modifying such a gun or trainer is quite high, and such modified gun, usually, can no longer be used for ordinary military (combat) purposes.

In this latter regard, a trainer, typically, will be an actual or slightly modified turret of a mobile howitzer gun, and, therefore, transportation thereof, as noted above, is at least as difficult as an actual mobile howitzer gun. Also, while the prior art devices do not deactivate an actual howitzer gun such that it could not be aimed and fired, the embedded prior art apparatus, along with its associated wiring and controls, gave a different appearance to a gun crew which could cause confusion on the part of a crew not familiar with such embedded apparatus.

Further, since detaching the embedded apparatus is both time consuming and complex, once an actual howitzer gun was so modified, a substantial reluctance to detaching the apparatus arose because of the risk that such attachment and detachment of the embedded apparatus could result in the aiming devices of the howitzer gun not being fully correctly reassembled and could cause aiming problems in subsequent combat use.

Further, such embedded apparatus was also used to test new procedures for operation, including aiming, of the howitzer gun, which might be required from time to time, even in field or even in combat use. Thus, detaching the embedded apparatus for field or combat use resulted in a necessity for reattaching the apparatus for such testing purposes, and each attachment and detachment not only takes the gun out of service for the time periods required therefor, but increased the above-noted risks.

While the foregoing is not a problem to the above extent with a trainer, in certain training exercises, the embedded apparatus interfered therewith and, thus, on occasion the detaching and subsequent re-attaching of the apparatus, along with the above-noted risk of imperfect reassembly of the aiming devices, was required.

It can therefore be seen that the problems associates with the prior art embedded apparatus are substantially common to both an actual howitzer gun and a trainer. Thus, the present invention is directed to both, and the term "howitzer gun" as used hereinafter, including the claims, is defined to mean an actual howitzer gun and a simulating trainer therefor.

Accordingly, it is clear that there is a need in the art for more appropriate means of training a crew for aiming and firing a howitzer gun, or a like gun, but no art has been developed to supply that need. For example, U.S. Pat. No. 5,215,462 uses sensors for determining the position of a simulated weapon relative to a target when a trigger sensor indicates that the simulated weapon's trigger has been pulled. While such sensors could be mounted and dismounted for use on different simulated weapons, the system of that patent is applicable only to simulated weapons and therefore would be of little value in realistic training of a crew on an actual howitzer gun.

Another approach in the art is disclosed in U.S. Pat. No. 3,798,795, where a target flight path is measured by an optical sensor and a radio ranging apparatus. Sensors determine the aim of the weapon for evaluating the accuracy of that aim in relation to the determined flight path of the target. However, that system is similar to those described above, in that the various sensors and other data acquisition devices are essentially permanently affixed to the weapon, other than the optical sensor and radio ranging apparatus. Accordingly, this approach of the prior art is also not satisfactory for training on howitzer guns for the reasons noted above.

Another approach in the art for gunnery training is illustrated by U.S. Pat. No. 2,795,057, where an image projector presents a realistic shadow image on a spherical screen using a model fighter airplane. The fire control system of the trainer is the same fire control system used in an aircraft to which the trainees are to be assigned. However, the sighting stand and the trainer itself are but a model of the weapon, and no actual field conditions can be imposed in that training exercise. Thus, here again, this approach of the prior art is unsatisfactory for present purposes.

On the other hand, U.S. Pat. No. 4,923,402 suggests the approach of a long range light pen to measure sighting accuracy, but since howitzers are not generally fired by line of sight, that approach is also inapplicable to the present situation.

Finally, an approach in the art is illustrated by U.S. Pat. No. 5,201,658, where an artillery simulator apparatus is provided. While the simulator attempts to simulate the action of the artillery piece and the various parameters of the firing, including aiming, this approach, nonetheless, is a simulator and not applicable to field use with a howitzer gun. Thus, here again, that approach in the prior art is not viable to the present situation.

In the above regards, the aiming device of a howitzer gun sets the gun deflection (azimuth) and elevation for firing a projectile at the correct angle for hitting the target. That aiming device has a "pantel" (a conventional shortened term for panoramic telescope), which provides a sight picture capable of viewing a distant reference collimator for alignment of the pantel with the collimator. The panoramic telescope or "pantel" must first be aligned with the reference collimator when the collimator is placed some distance from the howitzer. The pantel must also be levelled and, for accurate fire, must be levelled on two axes. By the gunner sighting the pantel on the collimator, the pantel can be aligned with that collimator, so that a precise position of the gun along the sight line with the collimator is determined. By then entering a desired deflection (azimuth) value into a pantel deflection setting means, the gun barrel, by returning the turret to that sight line, as explained more fully below, may be then positioned at that correct deflection.

At the same time, in order to correctly lay the howitzer's elevation on the target, the assistant gunner enters the desired elevation into a levelled quadrant setting means, and this causes a rotatable level indicator to be displaced from level. By returning to level, the gun barrel is elevated at the correct angle for accurately hitting the target, as explained more fully below. The quadrant must be first levelled, and the quadrant level indicator for indicating the level of the quadrant is used for this purpose. Here again, for accurate fire, the quadrant must be levelled on two axes, i.e. the level and the cross-level, similar to that mentioned above in connection with the pantel.

The foregoing aiming steps, as briefly described above, are carried out simultaneously by the gunner and assistant gunner, and in view of the required rapidity of fire in combat, those steps must be very quickly and accurately completed. Thus, in a training exercise, it is absolutely necessary for any evaluation of the performance of a crew not to interfere with that rapid aiming of the gun by the gunner and assistant gunner, which interference would be required for an evaluator to visually observe each setting or levelling as it occurs. Furthermore, for accurate training, any evaluation means must not introduce any devices which are substantially different from the actual aiming devices of the howitzer gun, since, otherwise, the training devices would not accurately simulate the motions and actions taken by the training crew when operating the actual aiming device. In addition, for realistic training, the evaluator should not be near the crew, so as to not interfere with the usual operation of the crew or to impose any nervousness thereon. Thus, the evaluator and any devices used for evaluation should be remote from the howitzer on which the training takes place.

Further, as briefly noted above, an important step in aiming a howitzer is that of aligning the pantel with the collimator by the gunner viewing the collimator in a sight picture of the pantel. The prior art devices had no means of remotely evaluating the position of the collimator in that sight picture, and, hence, an important part of the training exercise could not be remotely evaluated or evaluated without interrupting the training exercise.

Accordingly, it has been quite evident to those skilled in this art that the difficulties described above in connection with training a howitzer crew have not been overcome by the art and that there is a need for obviating those difficulties for the efficient training of a howitzer crew.

SUMMARY OF THE INVENTION

The present invention is based on several primary discoveries and several subsidiary discoveries.

First of all, as a primary discovery, it was found that by use of specific designs, as explained more fully below, training aiming devices can be manually removably attached to a howitzer gun such that those devices are not embedded in the howitzer gun and will have, substantially, the same visual appearance and feel of the actual aiming devices of that howitzer gun so that during training with such training devices the crew would experience substantially the same visual appearance and feel as would be experienced in use of the actual aiming devices themselves. This, of course, creates a very realistic training environment.

As a second primary discovery, it was found that such training aiming devices can be made such that the devices are easily and quickly attached to the howitzer gun without embedding and easily and quickly removed therefrom. Thus, any usual actual howitzer gun can be quickly adapted to a training gun and, subsequently, can be quickly adapted from a training gun to a combat gun. Likewise, trainers can be quickly and easily converted.

As a third primary discovery, it was found that such training devices could be made in kit form, so that the training devices can be easily transported to any howitzer gun, quickly attached to that gun for training purposes, e.g. in the field, which allows that gun for training purposes, and then quickly detached for returning that gun to intended purposes.

Further, since the present apparatus so successfully duplicates the appearance, feel and function of the aiming devices of a howitzer gun, the present apparatus can be left in place on the gun and the gun may be used for its intended purposes, e.g. combat use, without difficulties being engendered thereby.

As a subsidiary discovery, it was found that such training devices can be inexpensively made, such that the cost of training a howitzer crew with such devices is considerably less than the prior art, as explained above, where the apparatus was embedded in the aiming devices.

As a further subsidiary discovery, it was found that the kit form of the training devices allows such training devices to be widely deployed and implemented on a howitzer gun at any time additional training of a crew is determined to be required. Thus, wide latitude is provided under a number of different circumstances, including field conditions, for implementing additional training of a crew.

Finally, as a subsidiary discovery, it was found that all of the necessary training devices for complete training, including an evaluation of the pantel sight picture while viewing the collimator, as well as the settings and levels required to accurately set, aim and fire a howitzer could be included in such kit form, so that the training is not only far more realistic than the prior art devices but is inexpensive and usable on a ad hoc basis, while providing accurate evaluation of all of the necessary parameters, including the sight picture, which must be mastered by a crew for accurately aiming a howitzer gun.

Thus, the present invention provides a training apparatus which allows remote and substantially instantaneous evaluation of all of the alignment, settings and levels of a howitzer gun, as briefly described above. The training apparatus also conveys information to the evaluator for evaluating the performance of the crew in connection with all of the necessary aiming, including the sight picture, settings and levels, as briefly described above. To this end, a video means is provided for determining the positioning of the pantel by the gunner when viewing the collimator through the pantel. Encoders are provided for encoding signals responsive to the pantel deflection setting, as well as the quadrant setting and encoders are also provided for encoding signals responsive to the pantel level and the quadrant level. The term "encoder" is used herein in the broader sense of the term, i.e. a transfer from one system of communication into another system, and in specific applications of the invention refers to a device capable of determining either a movement or a setting of a manual input device, such as a hand-operated knob, and converting that movement or setting to a corresponding signal, e.g. electrical, light, magnetic, etc. signal. The video picture and the signals are received by a data processing computer for evaluation of the alignment, settings and levels achieved by the crew during a training exercise. Thus, the evaluator can be remote from the crew, while, at the same time, the evaluator can substantially instantaneously evaluate all of the parameters set by the crew for aiming the gun, i.e. the alignment, settings and levels.

Accordingly, very briefly stated, the present invention relates to a training apparatus and method and kit for a howitzer gun aiming device, which aiming device sets the gun's deflection and elevation and which aiming device has a pantel with a sight picture capable of viewing a distant collimator for alignment of the pantel with the collimator, a pantel deflection setting means for setting the pantel deflection and the deflection of the gun, a pantel level indicator for indicating the pantel level, a quadrant, a quadrant setting means for setting the quadrant and the gun elevation, and a quadrant level indicator for indicating the level of the quadrant.

The improvement of the present inventions involves the providing of a training apparatus, method and kit for remotely and substantially instantaneously evaluating the alignment, settings and levels. The apparatus includes a video means for manually removably attaching to the pantel and receiving the sight picture in the pantel or displaying a sight picture in the pantel. A pantel deflection setting encoder is provided for manually removably attaching to the pantel deflection setting means and encoding signals responsive to the pantel deflection setting. A pantel level encoder is manually removably attached to the pantel and encodes signals responsive to the pantel level. A quadrant setting encoder is manually removably attached to the quadrant setting means and encodes a signal responsive to the quadrant setting. A quadrant level encoder is manually removably attachable to the quadrant and encodes signals responsive to the quadrant level. Finally, an electronics box containing a data processing computer receives the sight picture in or controls and displays a simulated sight picture in the pantel, and also receives the signals for evaluation by the evaluator of the alignment, settings and levels achieved by the crew during the training exercise.

These elements form the kit of the training apparatus, and these elements, all being manually removably attached to (not embedded in) the appropriate parts of the aiming device, allow quick installation on any howitzer gun for training purposes and quick removal thereof for returning that gun to its intended purposes. The kit is light weight, easily portable, inexpensive and can be ruggedly constructed for field use. The elements of the apparatus also do not provide a substantially different visual appearance or feel, compared to the visual appearance and feel of the actual aiming devices of a howitzer gun. For example, the pantel deflection setting encoder is attachable to a pantel deflection setting input device of a howitzer gun, e.g. a knob, which input device is used for inputting a deflection value into the pantel deflection setting means. That pantel deflection setting encoder has a pantel deflection setting input device, e.g. a knob, which is substantially the same as the pantel deflection setting input device, so that an operation of the encoder input device is substantially the same as an operation of the setting input device.

DETAILED DESCRIPTION OF PREFERRED EMBODIMENTS

Figure 1A:
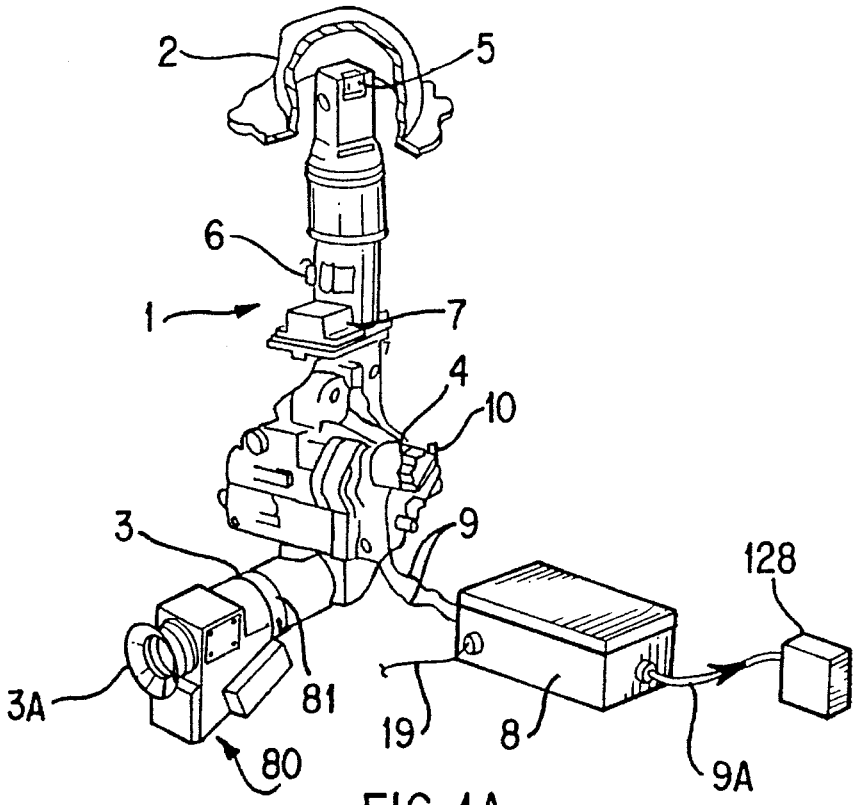
FIG. 1A is an isometric view of a pantel of a howitzer gun showing elements of the present apparatus installed thereon.

Before describing the invention, a more complete explanation of the aiming device of a howitzer gun is set forth for a better understanding of the invention. A conventional howitzer aiming device for setting the gun deflection and elevation includes two main groups of devices. The first group is the "pantel" (panoramic telescope) which is used for viewing a distant collimator so that the pantel may be aligned with the collimator and, thus, a precise line of reference is provided for the position of the gun barrel. Such a pantel is shown in FIG. 1A, where the pantel, generally 1, has a conventional ballistic shield 2, a telescopic barrel 3 with an eyepiece 3*a*, a pantel deflection setting means 4, an optical mirror 5, and a pantel level indicator 6 for indicating the pantel level.

FIG. 1A also shows elements of the present invention including the pantel level encoder 7, an electronics box 8 connected to the pantel 1 and to a readout device 128 (described more fully hereinafter) via wires 9 and 9*a* and is powered by line 19 connected to a power source.

Figure 2:
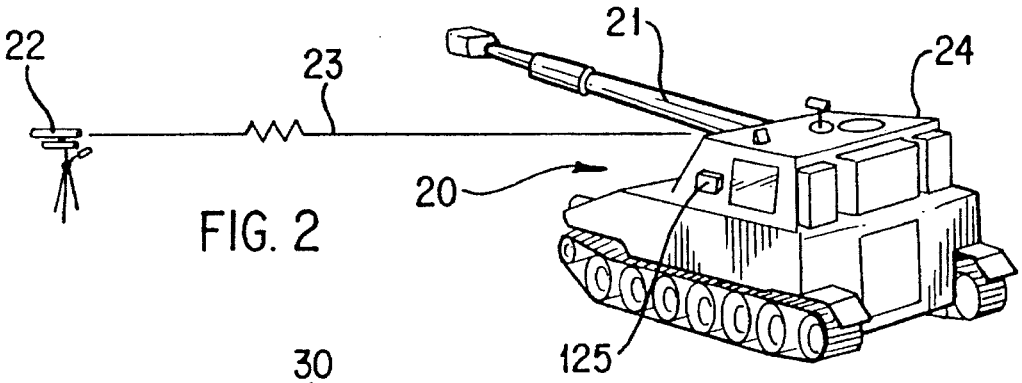
FIG. 2 is a diagrammatic illustration showing the use of a collimator in aligning the pantel therewith.

FIG. 2 is a diagrammatic illustration of the operation for aligning the pantel 1 mounted on a mobile howitzer, generally 20, having a gun barrel 21 with a collimator 22. The collimator 22 is a standard piece of equipment for setting the aim of howitzers, and while this equipment is well known to the art and need not be described in detail herein, briefly, the collimator projects a collimated light beam 23, which light beam can be viewed through optical mirror 5 (see FIG. 1A) and eyepiece 3*a*. The position of collimator 22 is established by engineers associated with a battery by way of a survey so as to place that collimator and resulting collimated light beam 23 at an exact position on a line of a grid map. The collimator is typically placed 15 to 40 feet, e.g. 25 feet, from the howitzer.

Figure 3A:
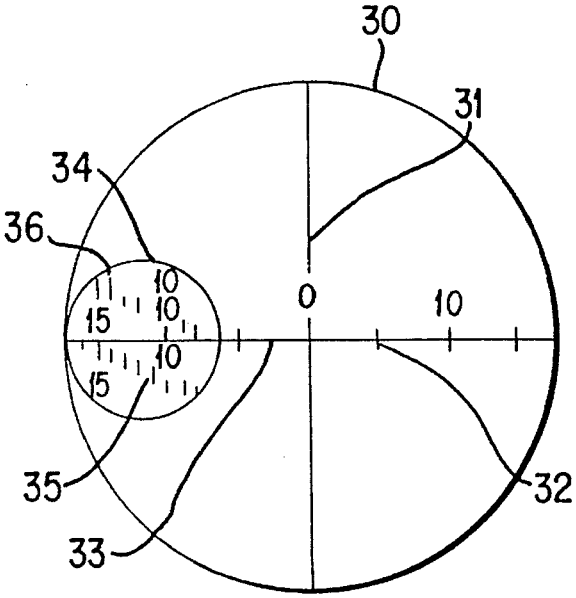
FIGS. 3A, 3B and 3C show typical pantel sight pictures as would be observed by the gunner in aligning the pantel with the collimator.
Figure 3B:
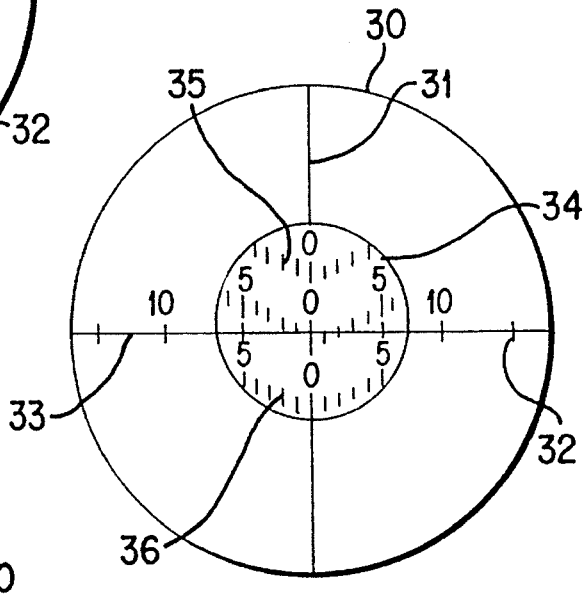
Figure 3C:
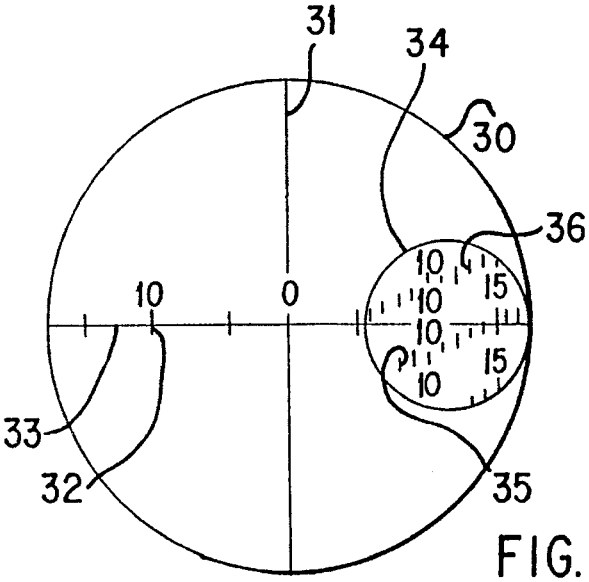
Figure 4:
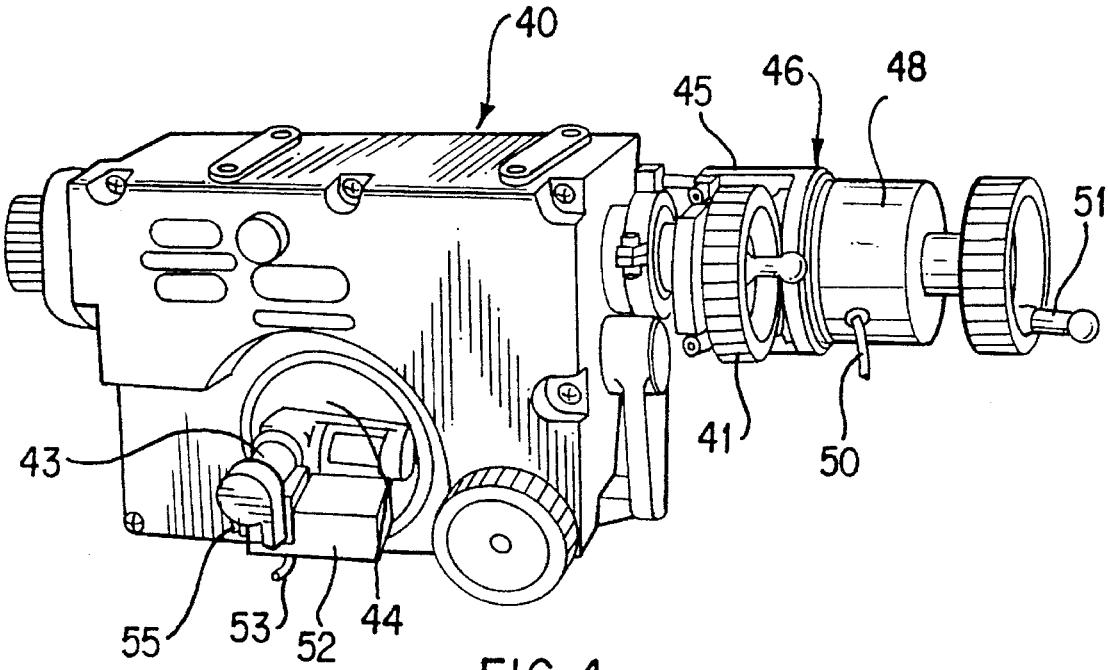
FIG. 4 shows a typical quadrant of the howitzer aiming device with a quadrant encoder installed thereon.
Figure 5:
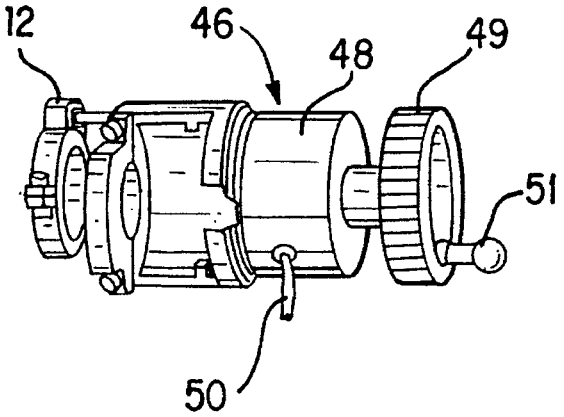
FIG. 5 shows the encoder of FIG. 4 in more detail.
Figure 6:
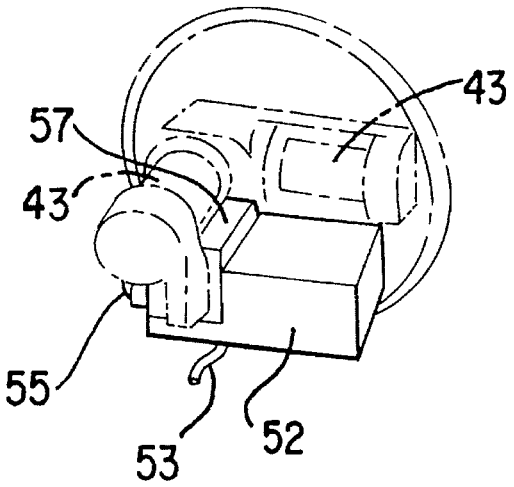
FIG. 6 is a detail of an installation of a quadrant level encoder on the quadrant.

In first setting up the howitzer for aiming purposes, the gunner first rotates the pantel 1 until the sight picture in the pantel is that similar to the pantel sight pictures shown in FIGS. 3A, 3B and 3C. It will be seen that the sight picture 30 displayed in the pantel 1 has superimposed thereon a pantel reticle 31 with numbered ticks 32 on the horizontal axis 33 thereof. The collimator 22 also projects a picture 34 having a collimator reticle 35 with numbered ticks 36.

In FIGS. 3A, 3B and 3C, the reticles of the pantel and the collimator are aligned, such that the gunner can be assured that the pantel 1 of mobile howitzer 20 (see FIG. 2) is aligned with collimated light beam 23, which therefore places the pantel 1 on a reference line related to the grid map in connection with which gun fire is to be exercised. In other words, the collimated light beam 23 forms a reference line from which the direction of fire (the deflection of the gun) is calculated. The actual operation of aligning the pantel 1 with the light beam 23 of collimator 22 is quite well established in the art, and need not be described herein for sake of conciseness. However, it is noted that, in that standard operation, it is not necessary for the sight picture 30 to be aligned with the collimator picture 34 such that there is no displacement between the two, as shown in FIG. 3B, but it is satisfactory that corresponding number tick marks be aligned, as shown in FIG. 3A and FIG. 3C, where it will be seen that in FIG. 3A tick numbers 10 align and in FIG. 3C tick numbers 10 also align.

Thus, to set the deflection of gun barrel 21, among other ways, the pantel and gun barrel are aligned with collimated light beam 23, and to set, for example, a 4,000 mils deflection of gun barrel 21, clockwise, as illustrated in FIG. 2, the pantel 1 and turret 24 are rotated counterclockwise, as viewed in FIG. 2, for 4,000 mils. A typical howitzer is set in deflection by conventionally used "mils". The mils range is from 0 to 6,400. Typically, the pantel deflection setting means 4 is initially set at 3,200 mils (half-way within the range). An order to fire at a deflection, as in the above example at 4,000 mils, is carried out by rotating the turret 24, clockwise, as shown in FIG. 2, until the pantel 1 again aligns with collimated light beam 23, which means that gun barrel 21 has, consequently, been rotated by turret 24 to 4,000 mils, clockwise, as viewed in FIG. 2, from the reference light beam 23.

In the above-described operation, pantel 1 is rotated to the desired amount, as exemplified above, by displacing the pantel deflection setting means 4 (see FIG. 1A). In the illustration of FIG. 1A, the pantel deflection setting means is shown as the usual rotatable knob 10, but could, of course, be any variable input device, such as a slide device, a crank, or even a digital input. Thus, for example, knob 10 is rotated by the gunner until the pantel is displaced 4,000 mils, counterclockwise, as viewed in FIG. 2, from collimated light beam 23, and then the above-described operation commences for setting the deflection of gun barrel 21.

Figure 1B:
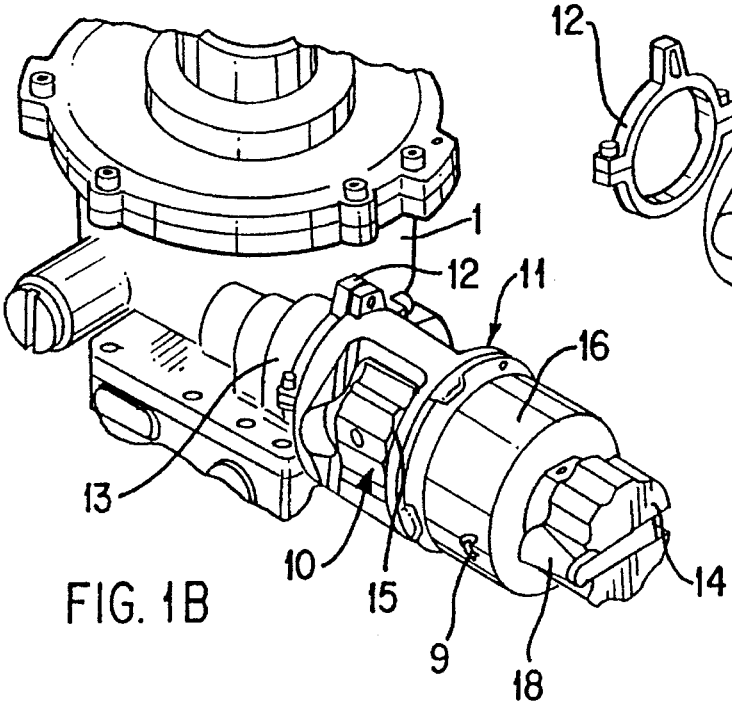
FIGS. 1B and 1C show details of the pantel deflection setting means and input device of FIG. 1A and details of the present pantel deflection setting encoder.

FIG. 1B shows an element of the present invention (an encoder) attached onto (not embedded in) that pantel knob 10. Illustrated in FIG. 1B is the arrangement of an M137 pantel, but, of course, the principals of the invention are equally applicable to other military pantels with arrangements somewhat different from that shown in FIG. 1B. As shown in FIG. 1B, a pantel deflection setting encoder, generally 11, is placed onto knob 10. As can be seen from FIG.. 1C, encoder 11 is mounted onto pantel 1 by way of a clamp 12 which mates with existing hardware 13 of the M137 pantel. That clamp 12 can be attached to existing hardware 13 in a manually removable attachment to the pantel deflection setting means, i.e. encoder 11 can be attached onto pantel 1 via hardware 13 by simple manual attachment with manually operated tools, e.g. screwdrivers, pliers, wrenches, socket sets, and the like, as may be appropriate for the particular hardware of a particular pantel and the particular clamp, or other arrangement, for attaching the encoder 11 onto that hardware 13.

As can be seen from FIG. 1B, the encoder has an encoder input device, i.e. knob 14, which is slaved to or responsive to the existing input device, i.e. knob 10. This is better shown in FIG.. 4 and FIG.. 5, which is specific to the same arrangement used in connection with the quadrant, as opposed to the pantel, but from FIG.. 4 it can be seen that the encoder, whether on the pantel or quadrant, is slaved to the input device by a connector 45.

Again considering FIG. 1B, it will be seen that knob 14 is essentially the same as knob 10 in terms of visual appearance and feel. Thus, as the trainee operates knob 14, there will be no noticeable difference to the trainee in the operation of knob 14, as opposed to the operation of knob 10. This provides very realistic training. Alternatively, knob 14 could be eliminated altogether, and the trainee could operate the existing knob 10 in setting the pantel deflection. Since encoder 11 is still slaved to knob 10, even without the presence of knob 14, the trainee's operation of existing knob 10 would actuate the encoder 11 in the same manner as the encoder 11 would be actuated by knob 14. The only difference in this alternative arrangement is that the trainee would feel the presence of encoder 11 when operating knob 10, and for that reason, this is not a preferred embodiment of the invention.

The encoder need only be capable of determining the displacement or setting of knob 10, as operated by knob 10 itself or knob 14, and a wide variety of encoders suitable for this function is well known to the art. Among others, the encoder may be a conventional variable resistance, potentiometer, a side of a wheatstone bridge, and the like (also known as resolvers, rotation encoders, etc.), but the more modern encoders of this nature are optical encoders. These optical encoders are very well known to the art and, for conciseness herein, will not be described in any detail.

Nevertheless, very briefly, these optical encoders operate, generally, by optically counting lines of degree for determining the degree of rotation of knob 14 (or knob 10). However, these optical encoders could easily be used without knob 14 simply by placing on the outer planar surface 15 of knob 10 a template with such markings, and optically read the number of markings during a rotation of existing knob 10. The template may be either secured mechanically or with adhesive, but, here again, operating existing knob 10 with encoder 11 thereon will not give exactly the same appearance or feel to the trainee as would knob 14, and, therefore, the use of an encoder without knob 14, as explained above, is not a preferred embodiment.

Alternatively, the encoders may be conventional magnetically-operated encoders or light-operated encoders or laser encoders or any other encoder, so long as the encoder can determine the ultimate setting of the pantel deflection setting means and the quadrant setting means. Thus, the particular encoder is not critical and may be chosen from a wide variety of available encoders.

The conventional encoder, as described above, is placed in a housing 16 which is ruggedly constructed for field use, for the reasons explained above. Data transmission wires 9 transmit the signals encoded by encoder 11 to an electronics box 8 (see FIG.. 1A) for analysis and/or further transmission via wires 9*a* to a readout device 128, as explained more fully hereinafter. Alternatively, instead of wires, the signals may be so transmitted by a light, electrical, etc. transmitter, e.g. a radio transmitter which converts the signals to radio waves, or a digital pulse, etc. The mode of transmission is not critical and may be chosen as desired, but usual transmission wires, as illustrated, are inexpensive and reliable and, hence, are preferred.

Of course, for firing a howitzer, not only the deflection, as explained above, but the elevation of the gun barrel 21 (see FIG.. 2) must be set. In a conventional howitzer arrangement, the howitzer gun barrel elevation is set by a conventional quadrant, and FIG.. 4 shows such a conventional quadrant, and, in particular, an M15 quadrant. In FIG.. 4, a quadrant, generally 40, has a quadrant input device, i.e. knob 41, which effects the functions of the quadrant setting means. The quadrant setting means 41 is conventional in the art and need not be described herein for sake of conciseness.

As an example, if the fire commander ordered the gun crew to set the deflection at 4,000 mils, as discussed above, and the elevation at 350 mils (usually the elevation range of mils is 0 to 1,600), the quadrant is first levelled by viewing quadrant level indicator 43, and then quadrant setting means, e.g. knob 41, is operated to set the 350 mils elevation. This causes a rotation of the quadrant level indicator 43 by that amount from level. The gun barrel is then raised until the quadrant level indicator 43 is again levelled. To this purpose, quadrant level indicator 43 is mounted on a quadrant rotating assembly 44, all of which is conventional and need not be described herein for sake of conciseness.

Figure 1C:
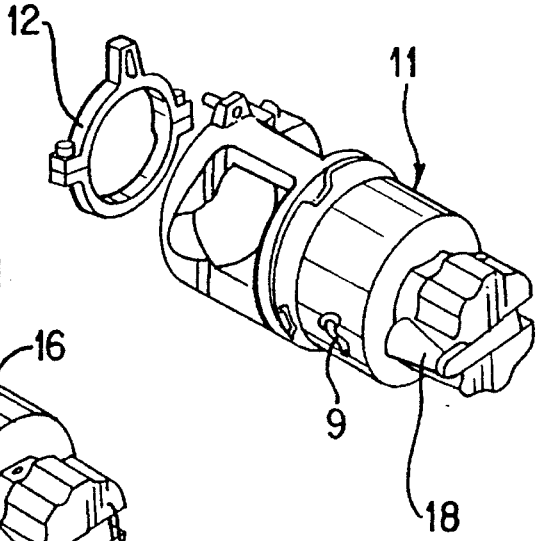

As mentioned earlier, the existing knob 41 is slaved to the quadrant setting encoder, generally 46, which is shown in more detail in FIG.. 5. Encoder 46 may be identical to the pantel deflection setting encoder 11 (see FIGS. 1B and 1C) or it may be any of the other above-mentioned conventional encoders. Thus, it is not necessary to again repeat the operation of those encoders, and it is to be understood that, usually, the encoders have the same operation and construction as those described in connection with pantel deflection setting encoder 11, in regard to FIG.S. 1A, 1B and 1C. However, it will be noted that, similar to pantel deflection setting encoder 11, quadrant setting encoder 46 also has a housing 48, encoder knob 49 and data transmission wires 50 (although other transmission devices, as noted above, may be used). Also, the encoder knob 49 may have a crank 51 which may be similar to or different from the crank 18 shown in FIGS. 1B and 1C.

Again, the quadrant setting encoder 46 is manually removably attachable to the quadrant setting means 41, e.g. by hand operation and with hand tools as explained above in connection with the mounting and dismounting of pantel deflection setting encoder 11.

Turning now to the level indicators, i.e. a pantel level indicator for indicating the pantel level and the quadrant level indicator for indicating the quadrant level, as shown in FIG.. 4, the quadrant, generally 40, has a rotatable assembly 44 carrying the quadrant level indicator 43, and that level indicator, of course, is used in the conventional manner to level the quadrant for aiming purposes, as described above. A similar pantel level indicator 6 is shown in FIG. 1A. The operation of the level indicator in regard to either the quadrant or the pantel need not be described herein, since those level indicators are operated in the usual and conventional manner.

The present invention includes a pantel level encoder for manually removably attaching to the pantel and encoding signals responsive to the pantel level. Likewise, the invention includes a quadrant level encoder for manually removably attaching to the quadrant and encoding signals responsive to the quadrant level. Since both of these level encoders operate in the same manner, only the quadrant level encoder will be described in detail, for sake of conciseness.

As seen in FIG.. 4, the quadrant level indicator 43 for indicating the level of the quadrant is, as is the usual case, a two-axis level indicator, and the present invention likewise provides a two-axis quadrant level encoder 52. In the most preferred embodiment, the level encoder (for both the pantel and the quadrant) is an inclinometer, of standard design and commercially available, wherein the inclinometer is capable of determining the level and cross-level of the pantel or quadrant, as attached to the respective ones thereof. These devices are well known, and the inclinators are preferably two-axis electrolytic tilt sensors. These two-axis electrolytic tilt sensors, when attached to the pantel or quadrant, encode signals responsive to the pantel level or the quadrant level, respectively. Therefore, these sensors, being inclinometers, determine the level and the cross-level of the pantel or quadrant, respectively. The signals encoded by the encoders, which are responsive to the pantel level and quadrant level, respectively, are transmitted to the electronics box 8 (see FIG.. 1) by way of appropriate wires 53 (see FIG.. 4)

FIG.. 6 shows the quadrant level encoder 52 in more detail. As can be seen from FIG.. 6, the electrolytic inclinator (encoder) 52 is attached by clamps 55, which clamps are held in place by a bracket 57. As can be seen from the phantom lines of FIG.. 6, bracket 57 locks to quadrant level indicator 43.

However, any means of attachment may be used, including various clamps, brackets, straps, screws, bolts, bayonet sockets, and the like, and the particular mechanical means of attaching is not critical and may be as desired, so long as a secure attachment is made and so long as either of the level encoders is manually removably attached to the pantel or quadrant, respectively.

The pantel level encoder 7 may be a conventional electronic device and mounted, e.g., on the pantel, as shown in FIG.. 7, by means of a fitting bracket 59. Of course, in regard to both level encoders, before use in training, they must be calibrated to level and cross-level or adjusted in position on the pantel/quadrant to level and cross-level.

Figure 7:
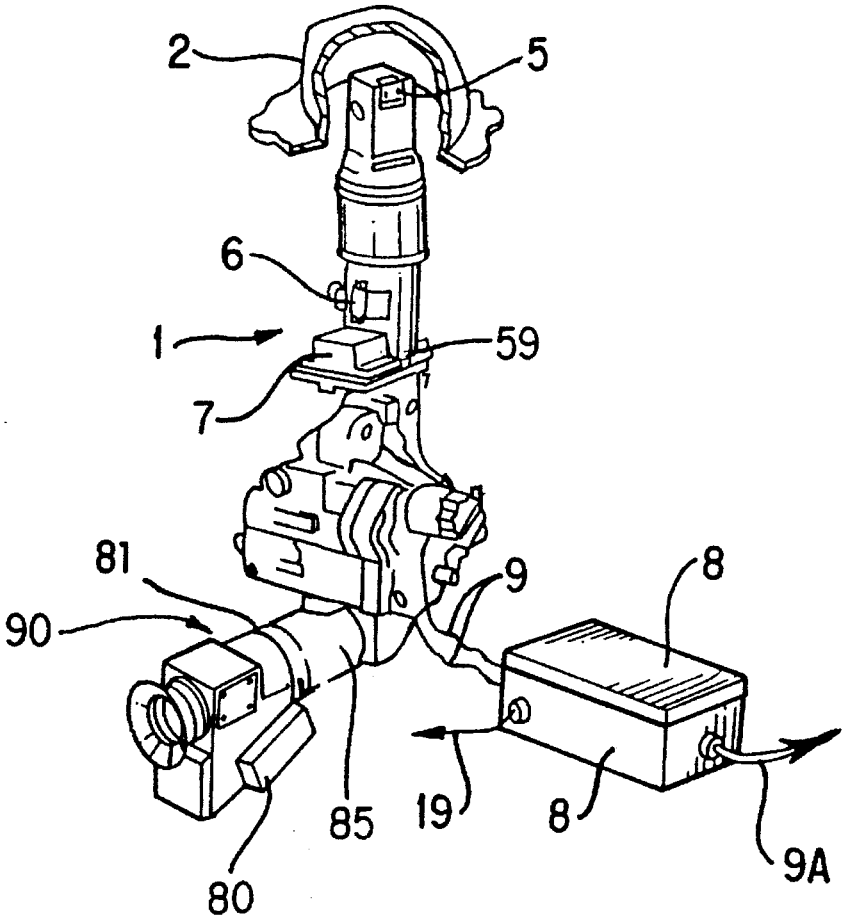
FIG. 7 shows the video means attached to the pantel for receiving or displaying a sight picture in the pantel.

The above describes, in detail, the pantel deflection setting encoder, pantel level encoder, quadrant setting encoder and quadrant level encoder, but in order to determine the accuracy of a crew in training, the sight picture in the pantel, when aligning with the collimator, as explained above, must also be accurately determined. In this regard, there are two preferred embodiments. In both embodiments, and as shown in FIG. 7, a video means 80 is attached at barrel 85 to the panoramic telescope (pantel), generally 1, for manually removably attaching to the pantel, e.g. by way of the clamp 81 or other appropriate means for manually removably attaching the video means to the pantel, as described above.

In the first embodiment, that video means is capable of receiving the sight picture in the pantel, and in the second embodiment, that video means is capable of displaying a synthetic sight picture in the pantel, both of which embodiments will be described more fully below.

Figure 8:
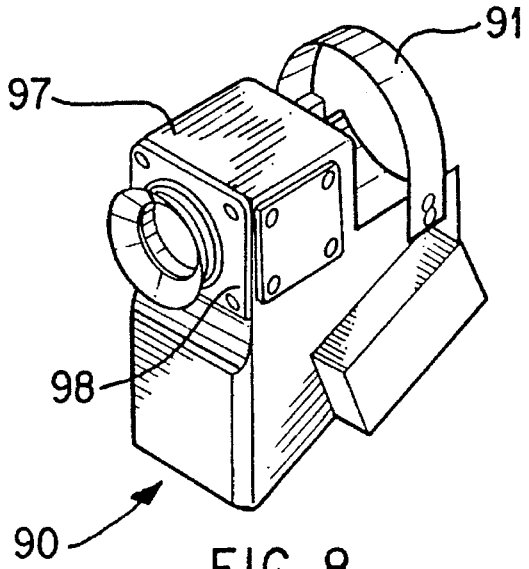
FIG. 8 is an isometric view of a preferred embodiment of the video means.
Figure 9:
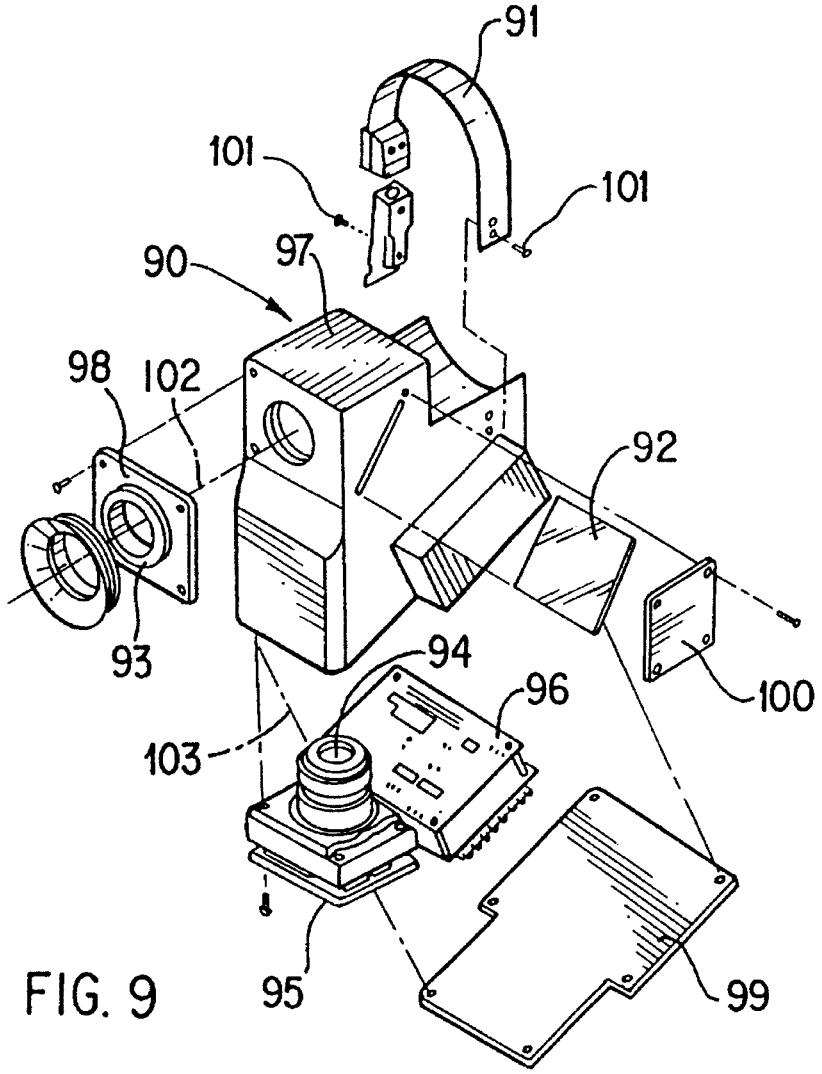
FIG. 9 is an exploded view of FIG. 8.

FIG.S. 8 and 9 show the first embodiment. In this connection, as explained above, the image which the gunner sees in the pantel optics is depicted in FIGS. 3A, 3B and 3C. This is called the "sight picture", as explained above. In this embodiment, as shown in FIG. 8, a video recognition unit, generally 90, has a clamp means 91 and, as shown in FIG. 9, which is an exploded view of FIG. 8, has an optical beam splitter 92 for splitting the image in the pantel into two image beams, with one image beam being directed to the eyepiece lens 93 and one beam being directed to a lens assembly 94 of a video camera 95, which video camera 95 has a computer controller 96. The video recognition unit 90 has associated conventional mechanical devices for holding the video camera 95 and the beam splitter 92, e.g. a housing 97, an eye shield housing 98, and cover plates 99 and 100. The clamp 91 can be any form, such as the strap shown in FIGS. 8 and 9, and affixed to the housing 97 by way of screws 101, or the like. The clamp 91 affixes the video recognition unit 90 to the pantel telescopic barrel 3 (see FIG. 1A). The optical beam splitter 92 is placed in close proximity to and at a 45° angle to the eyepiece lens 93. This separates the image in the pantel into two image paths at perpendicular angles.

The original image path 102 is viewed by the trainee without noticeable change through new eyepiece lens 93. The perpendicular image path 103 is captured by the lens assembly 94 of the video camera 95 and focused by that lens assembly. Thus, the electronic image captured by the video camera 95 is identical to that viewed by the trainee. Of course, all optical elements are mounted in a rigid fixture and in a rigid manner to provide proper optical alignment. The video recognition unit 90 provides a new eyepiece lens 93, and it will be noted from FIGS. 7, 8 and 9 that this arrangement provides for minimal displacement of the eyepiece lens 93 from that of the usual eyepiece lens of the usual pantel. The video camera 95 and the computer controller 96 therefor are conventional pieces of equipment, and need not be described herein in detail for sake of conciseness.

However, the image is composed of three independent image elements. First, the entire image area is filled with a background scene, which would be the scene beyond the collimator, and might be trees, hills, bushes, etc. The background scene will be largely unknown, since it will depend upon the particular location in which the training exercise is carried out. Second, some portion of that scene will contain the collimator picture 34 (see FIGS. 3A, 3B and 3C), also showing the collimator reticle 35. That collimator picture 34 will be more brightly illuminated than the background, since that collimator picture 34 is a projected bright light. As explained above, the alignment is achieved with the collimator reticle that is visible within the pantel picture, and the small tick marks are used to precisely locate the positions of the reticle of the collimator.

The third element is the pantel reticle, also containing numbers and ticks, that is superimposed over the reticle of the collimator in the sight picture (see pantel reticle 31 in FIGS. 3A, 3B and 3C).

Thus, since the evaluator, via video camera 95, sees the exact same picture as the trainee when aligning the pantel with the collimator, the evaluator may visually determine the accuracy of the trainee's alignment. However, this is not a preferred embodiment, since it would require close attention of the evaluator, especially in view of the speed the trainee attempts to use in setting the alignment. In addition, one evaluator may be monitoring more than one training crew, and this would considerably delay the training rapidity of each crew. Thus, in a preferred embodiment, this evaluation is done electronically.

In this latter regard, the apparatus of the invention also includes an electronics box 8 (see FIG. 1A) for receiving and analyzing the sight picture in this embodiment of the video means. The electronics box will also receive the signals from the pantel deflection setting encoder, the pantel level encoder, the quadrant setting encoder and the quadrant level encoder for an evaluation of all of the alignment, settings and levels achieved by the trainees during an exercise. A typical analog for a computer program used with electronics box 8 is described below in Table 1, but, briefly, the evaluation of the image for alignment is carried out in two steps.

In the first step, the pantel reticle image contents are evaluated and stored in memory. The camera's exposure is computed and adjusted to provide a high contrast between the brighter collimator picture 34 and the darker background. All reticle features are located and stored in memory, digitally, by a computer card in box 8 (described more fully below), and all tick marks are likewise precisely located and stored in memory. Since each tick exceeds one pixel in width, horizontal scans across the ticks allow the density of each individual pixel to be mathematically combined to locate the true center of each tick. The scanning is done for all available horizontal paths across a pixel. Thus, averaging the results for all scans further reduces the effective noise and improves the accuracy of tick location. For the foregoing purposes, a conventional frame grabber card may be used in box 8 to freeze the picture of the final settings, as explained below. All of the foregoing modes of analysis are, generally, conventional in the art in regard to evaluating, by conventional software, images displayable in a video picture, and need not be described in any further detail for sake of conciseness.

In the second step, the collimator picture is evaluated. As noted above, the image contrast is computer controlled by electronics box 8 and camera computer controller 96 to provide a high contrast of the collimator features. Because the collimator circle is more brightly illuminated, as explained above, than the background, this causes the background image to be very dark. The software locates the collimator picture by virtue of the differences in brightness between the dark background and the collimator picture 34. Numerals within the collimator picture are located in a manner similar to that explained above and stored in memory. Each numeral is thus identifiable and correlatable with the numeral region of previously stored images with all numbers, as noted above. Thus, the tick corresponding to the numeral is precisely located using the same method as was used for the reticle ticks. While only one or a few ticks need be evaluated, evaluating all numerical ticks within the collimator picture and combining those results improves the accuracy of the electronic analysis. Of course, any collimator picture feature that corresponds in location to a feature of the pantel reticle must be ignored to prevent ambiguous or distorted results, and this is achieved by a comparison made by the computer in box 8. Here again, the means of such electron evaluation is conventional in the art and will not be further explained for sake of conciseness.

After both the pantel reticle and a collimator picture have been evaluated, the results can be compared to compute the accuracy of image alignment achieved by the trainee. Since, with some minimum training, the trainee will normally proceed substantially correctly in alignment of the pantel, a knowledge of that intended operation by the trainee and the physical geometry of the training sight can be used to predict the most likely contents and location of the image elements, and with such prediction, the data processing computer in box 8 can be controlled to focus more narrowly on those expected results and, thus, speed up the analysis thereof. Accordingly, the result of a sight picture setting, along with the results of the pantel setting, the pantel levels, the quadrant setting and the quadrant levels are compared with the desired results which should be achieved by the trainee. The trainee's evaluation data can be generated either at electronics box 8 for a single howitzer or in a separate instructor operator station (IOS) a distance from the trainees where more than one trainee crew may be evaluated at one time, as explained more fully below.

Figure 10:
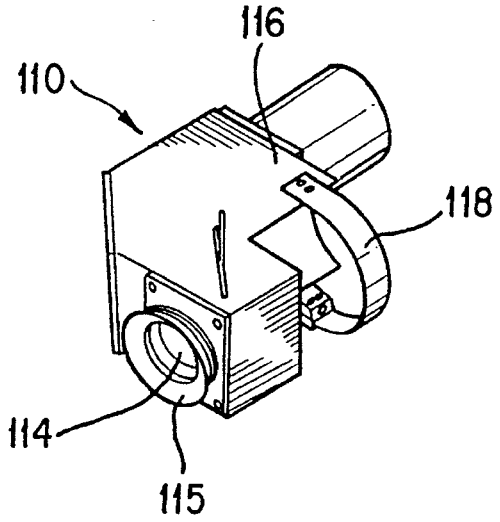
FIG. 10 is an isometric view of another embodiment of the invention where the video means displays a synthetic sight picture in the pantel.
Figure 11:
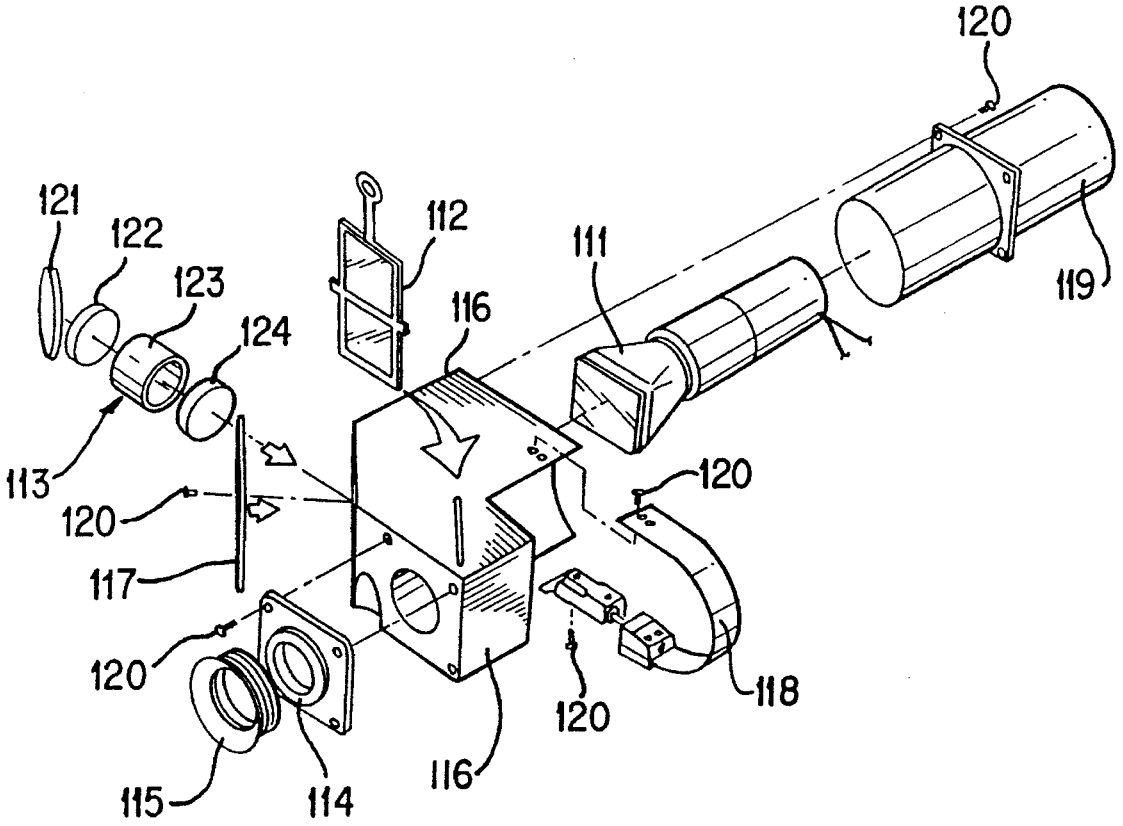
FIG. 11 is an exploded view of FIG. 10.

In the second embodiment, the video camera 80 (see FIG. 1A) displays a synthesized sight picture in the pantel, and FIGS. 10 and 11 show that embodiment. As shown in FIG. 10, the video means in this embodiment includes a video synthesizing unit, generally 110, and in FIG. 11, an exploded view thereof is shown. The video synthesizing unit 110 includes a mini-high resolution VGA monitor 111, a movable mirror 112 and a lens assembly, generally 113, an eyepiece lens 114, and an eyepiece shield 115 contained in a rigid housing 116. The housing has appropriate mounting plates, e.g. mounting plate 117, for access to housing 116 in assembly of the components. In addition, the video synthesizing unit includes a clamp 118 for clamping the video synthesizing unit 110 onto the pantel telescopic barrel 3 (see FIG. 1A). The clamp is held in place by appropriate screws 120. The VGA monitor 111 is contained in a mounting tube 119 which is held to housing 116 by screws 120. The lens assembly 113 is composed of a mirror 121, lens 122, spacer 123 and lens 124.

The embodiment of the video synthesizing unit 110 is most useful in a classroom setting, or in other than in field use, where the usual sight picture, including the background foliage, hills, etc., will not be present. In this case, to make the sight picture realistic, a synthesized video sight picture is displayed in the mini-high resolution monitor 111. The mirror 112 is placed at a 45° angle to the eyepiece lens 114, and synthesized moving images are displayed on the mini-high resolution monitor 111. The images are reflected by mirror 121 and focused by lens assembly 113 on mirror 112. This injects the synthesized images from the monitor 111 into eyepiece lens 114 and into the eye of the gunner. If mirror 112 is removed, then eyepiece 114 sees directly the image in the pantel clamped to housing 116 by clamp 118, instead of the synthetic picture displayed by monitor 111. Of course, all of the optical elements are mounted in rigid housing 116 for alignment of those components. The video synthesizing unit 110 is therefore securely attached to the pantel and provides a new eyepiece for the trainee's viewing.

At the same time, the input images generated by the trainee are reflected onto the scene displayed by the monitor 111. Thus, by knowing the sight picture (frame) which the trainee selects for final alignment purposes, the accuracy of the trainee's performance can be evaluated.

However, in this embodiment, since a synthesized moving picture is displayed to the trainee, an additional encoder will be required to detect and measure the movement of the turret, and to this end, a turret encoder 125 (see FIG. 2) is also manually removably attached to the turret. Since a synthesized picture is displayed to the trainee, only the motion of the turret need be known, and that encoder can be an inexpensive gyroscope, for example, or any other motion detector. Such motion detectors must also be capable of encoding the movement of the turret, and the encoded signal must, of course, also be conveyed by wires and the like, as explained above, to electronics box 8, and optionally, as explained more fully below, to an instructor operator station (IOS).

The synthetic picture most usually will be an actual video picture taken of a representative locale in the field for a collimator, and the picture will be a moving picture which will correspond to the movements of the pantel engendered by the trainee. For example, the moving picture displayed in the monitor will show a panorama as the synthesized picture duplicates the movement of the pantel toward the collimator and the like, as explained above in connection with the first embodiment of the video means. This can easily be achieved by coordination of the frames of the moving picture with the movement of the pantel by the trainee. A video graphics card in electronics box 8 is used for this purpose, as explained below.

Whether the first embodiment or the second embodiment is used, and in combination with the pantel deflection setting encoder, pantel level encoder, quadrant setting encoder and quadrant level encoder, as well as the turret encoder for the second embodiment, all have encoded signals which are transmitted to electronics box 8 (see FIG. 1A). Box 8 has a data processing computer card for receiving and analyzing the sight picture, as in the first embodiment, or, in combination with a graphics card, displaying or controlling a synthesized sight picture, as in the second embodiment, in the pantel and for receiving the signals of the various encoders and for evaluation of the alignment, settings and levels thereof. While any computer card can be used for this purpose, since it is only a data processing computer card, a suitable 486 card is satisfactory. Alternatively, a separate computer may be used, e.g. a 486 computer packaged in a military PC-104 format for durability, weight and size, instead of a computer card in box 8. However, neither the 486 capability or the PC-104 military format is necessary to provide the function thereof.

From the above description of both embodiments of the video means, it will be seen that, in connection with the first embodiment, the beam splitter 92 is in close proximity to the eyepiece lens 93 such that the video recognition unit 90 does not substantially interfere or make significantly different the usual appearance and feel of the eyepiece lens 93, as opposed to that of a howitzer without the present apparatus mounted thereon. The same is true for video synthesizing unit 110, in the second embodiment. In the first embodiment, since the video camera controller 96 is, in fact, in the nature of a computer-controlled camera, a commercially available item, that camera can be controlled by the computer of the camera or the computer card or separate computer such that the collimator image can be displayed more brightly than background images, and this makes the above-described analysis of that sight picture far more easy to achieve.

Also, in the first embodiment, where the image in the pantel has a reticle and the collimator picture of the collimator has a reticle, and the alignment of the gun is achievable by aligning the reticles, as explained above, it is very easy for the data processing computer card or separate computer to compare the reticle of the collimator picture with the reticle of the pantel so as to easily determine the accuracy of alignment made by the trainee.

In order to easily accommodate either the first embodiment or the second embodiment as alternatives in a single "kit" form, while not required, electronics box 8 may include all of the above-described electronics. The box 8 may contain, among others, a 486 computer card, as noted above, an interface card, a video card, and an encoder input card (level and setting cards may be separate or combined). These cards may be placed in a usual enclosure, e.g. a NEMA-6 enclosure, with appropriate input and output connectors. The video card may have incorporated therein, or as a separate card, a conventional frame grabber card for the first embodiment and a VGA graphics card for the second embodiment. Thus, by either switching these two latter cards, either manually or by conventional switching means, electronics box 8 may be activated for either the first or second embodiment, as the specifics of the training require, and the same electronics box is, therefore, applicable to either embodiment.

The frame grabber card, of course, allows a frozen frame of the final pantel sight picture for the evaluation thereof as described above in connection with the first embodiment, and the graphics card allows control of the moving synthetic sight picture in the second embodiment, all of which is well known in the art and need not be further described for sake of conciseness.

As can be appreciated, electronics box 8 contains all electronics needed for evaluation of the crew's performance. While any or all of the cards may be in separate housings, and the computer card may be a separate computer, it is preferred that all of the cards be in a single electronics box 8 for the following reasons.

Video signals and computer input/output data can, of course, be transmitted by usual connector cables, but whether serial or parallel ports are used, the permissible distance spanned by such cables is limited. It is, therefore, preferable that each howitzer used as a trainer have its own electronics box 8 mounted near or on the howitzer. Thus, with a single electronics box 8, such mounting and cable connection is simplified.

Further, with a separate electronics box 8 for each training howitzer, the outputs thereof can be sent directly to a readout device 128, e.g. a "dumb" terminal, a printer or a separate computer with a keyboard and monitor, for independent evaluation of the performance of the crew of that howitzer by an instructor (referred to as Instructor Operator Station—IOS). Alternatively, that IOS could be spaced from that howitzer by a considerable distance such that readout devices can receive the analyzed data from box 8 with long cables.

Even more importantly with a distant placed IOS, an evaluator can evaluate a number of training crews at the same time by using a readout device connected to a number of boxes 8 of separate crews. This allows co-ordinated training of a number of different crews by a single evaluator or a single group of evaluators. In this latter case, even if the evaluator(s) were close to the number of crews, a single computer or computer card could not handle all of the data from a number of training crews at the same time, unless the computer is a very high speed computer, which has considerable bulk and environmental requirements. This, of course, would be inconsistent with intended field use. Therefore, the use of an electronics box 8 for each howitzer is particularly preferred.

As mentioned above, the particular encoders are not critical and can be chosen from a wide variety of conventional encoders. However, a very useful encoder is an RM-15 encoder manufactured by Renco Encoders, Inc. of Goleta, Calif. These are sealed encoders of light weight, with ±2 min. of arc, using an LED light source (see U.S. Pat. No. 5,057,684), and are easy to attach by way of brackets with only the human hand or human hand tools.

All of the elements of the apparatus, as discussed above, are easily fittable into a hand carry kit form, e.g. in a carrier similar to a brief case, and can therefore be easily transferred from one location to another. Since each element for fitting onto the existing howitzer aiming devices is manually removably attachable to the existing devices, the elements can be quickly attached for training and quickly detached for returning the howitzer to intended purposes, even in field use.

As noted above, the elements are manually removably attachable to the existing aiming devices of the howitzer with usual hand tools or even by hand alone, so that no complicated tools or instructions are needed for attaching and detaching the elements. This also makes the kit form very viable, since the kit may contain such simple hand tools as necessary for attachment to a particular model of a howitzer. In this regard, the term "manually removably attaching" is defined to mean attachment and detachment by human hands with only the aid of human hand-operated, non-powered, hand tools, e.g. pliers, wrenches, screwdrivers, clamps, and the like and, specifically, not embedded in the aiming devices as with the prior art. The attachment devices themselves, as illustrated in the drawings, may be, among others, screws, straps, clamps, brackets and the like.

In addition, since the pantel deflection setting encoder 11 and the quadrant setting encoder 46 are attachable to the pantel deflection setting means 4, and the quadrant setting means 41, respectively, and since the appearance of each of these, as well as the feel, are approximately the same, this does not significantly interfere with the realistic operation of the howitzer with the present apparatus thereon, as opposed to that operation without the present apparatus thereon. Thus, a realistic training is provided. In other words, the pantel deflection setting encoder has a pantel deflection setting input device, e.g. knob, which is substantially the same as the pantel deflection setting input device, e.g. knob, so that the operation of the encoder input device is substantially the same as the operation of the setting input device. Likewise, since the quadrant setting encoder has a quadrant setting input device, e.g. knob, which is substantially the same as the quadrant setting input device, e.g. knob, the operation of the encoder input device is substantially the same as the operation of the setting input device.

As can therefore be seen, the present invention provides a training apparatus for remotely and substantially simultaneously evaluating the alignment, settings and levels entered into a training howitzer during training exercises. It will also be seen that the present apparatus and all elements thereof can be easily manually removably attached to the pantel deflection setting means, the pantel, the quadrant, the quadrant level, etc. for easily converting the howitzer gun to a training device and for easily reconverting that howitzer gun back to intended purposes. The present apparatus can be easily provided in kit form and transported to the field for training exercises, or the present device, with the second embodiment of the video means described above, can be used to convert a howitzer gun for an indoor or classroom situation use and easily reconvert that howitzer gun back to intended purposes.

While, as described above, the present apparatus can be easily attached to and detached from an actual howitzer gun, the apparatus is also so attachable to and detachable from a simulated howitzer gun, i.e. a trainer which is not actually a fireable gun, as noted above. For example, such howitzer trainers are now available for classroom or the like training, and the apparatus may be attached thereto. In this case, usually, the second embodiment of the video means would be used, although the first embodiment of the video means could be used if some acceptable panorama is available. The first embodiment of the video means would usually be used in the field for either a howitzer gun or a trainer, although the second embodiment of the video means may be used in the field where the panorama is restricted or where training is desired with a panorama different from the naturally occurring panorama, e.g. a desert panorama is desired for training rather than the natural forest panorama where the gun or trainer is located. For these reasons, as noted above, the term "howitzer gun" is defined as either a fireable, actual howitzer gun or a trainer/simulator of a howitzer gun. While the software for achieving the above can be almost as desired, so long as the above functions are obtained, and can be easily devised by one of ordinary skill in the art, a typical analog for such software is presented below in Table 1. While this analog is typical for use with a variety of howitzers (see value H), this particular analog need not be used, and any other analog which will achieve the above functions, which can be easily devised by one of ordinary skill in the art, may be used.

TABLE 1

| VALUE | COMMAND | I/O | ASCII DIGITS | DATA | COMMENTS |
|---|---|---|---|---|---|
| I | SET STATION ID | IN | 2 | ID VALUE (1 through 8) | |
| | | OUT | 4 | STATUS (see below) | |
| S | QUERY RUN STATUS | OUT | 4 | INDIVIDUAL BITS PACKED INTO AN INTEGER AND TRANSMITTED AS A SINGLE ASCII NUMBER.<br>BIT 0 = TRUE FOR INSTRUCTOR OPERATION STATION (IOS) MESSAGE PROTOCOL ERROR<br>BIT 1 = TRUE FOR COMMAND ERROR<br>BIT 2 = TRUE FOR FIRE DATA PACKET READY<br>BITS 3, 4 = SOLUTION STATUS<br>BITS 5, 6 = TRACKING STATUS<br>BITS 7–12 = PROCESSING MODES | SOLUTION STATUS BITS:<br>0 = High Confidence Solution<br>1 = Medium confidence Solution<br>2 = Low confidence Solution<br>3 = No Solution<br>TRACKING STATUS BITS:<br>0 = Not Tracking<br>1 = Successfully Tracking<br>2 = Out of Tracking Range<br>3 = Marginal Tracking<br>PROCESSING MODE BITS:<br>0 = Idle |
| H | SET HOWITZER ID | IN | 2 | 0 = None<br>1 = M102<br>2 = M109A1<br>3 = M198<br>4 = M109<br>5 = M109A6<br>6 = HCT | |
| | | OUT | 4 | STATUS (see above) | |
| O | SET OPERATING MODE | IN | 2 | 0 = IDLE<br>1 = PANTEL SETUP (ONLY)<br>2 = COLLIMATOR SETUP (ONLY)<br>3 = TRACK COLLIMATOR<br>4 = SOLVE COLLIMATOR<br>5 = PANTEL SETUP AND CONTINUE<br>6 = COLLIMATOR SETUP AND CONTINUE<br>(11–15 Debugging) | 11 - faster shutter and display<br>12 - slower shutter and display<br>13 - exit<br>14 - continuous full frame display<br>15 - continuous magnified display |
| | | OUT | 4 | STATUS (see above) | |
| D | STATUS PANTEL QUADRANT PICTURE DATA | OUT | 4 | STATUS (see above) | See Command S |
| | | | 12 | LOCAL CLOCK (0.1 sec) | 10 DIGITS |
| | | | 12 | PANTEL X LEVEL ERROR | |
| | | | 12 | PANTEL Y LEVEL ERROR | |
| | | | 12 | PANTEL ENTERED VALUE | |
| | | | 12 | PANTEL SIGHT PIX ERROR | |
| | | | 12 | QUADRANT X LEVEL ERROR | |
| | | | 12 | QUADRANT Y LEVEL ERROR | |
| | | | 12 | QUADRANT ENTERED VALUE | |
| | | | 12 | DEFLECTION | |
| | | | 12 | ELEVATION | |
| E | QUERY ERROR MESSAGE | OUT | 4 | STATUS (see above) | See Command S |
| | | | 5 | 0 = NO ERRORS<br>nnnnn = ERROR NUMBER | First digit is severity:<br>0 = Info, 1 = Error, 2 = Fatal, 3 = Safety |
| R | RESET | IN | 0 | N/A | |
| | | OUT | 4 | STATUS (see above) | |
| Q | SET DEBUG DATA | IN | 2 | DEBUG SELECTOR | |
| | | | 3 | DEBUG VALUE | |

TABLE 1-continued

| VALUE | COMMAND | I/O | ASCII DIGITS | DATA | COMMENTS |
|---|---|---|---|---|---|
| | | OUT | 4 | STATUS (see above) | |
| q | DEBUG QUERY AND CONTROL | IN & OUT | 2 | ACTION SELECTOR | Query Types: 1 - Debug Values 2 - Memory Heap Available 3 - Shutter/Threshold Settings 4 - Images Defined 5 - Set S Video Mode 6 - Set Composite Mode |
| | | | 4 | STATUS (see above) | |
| | | | string | RESPONSE STRING | |
| F | SET FIRE SWITCH PUSHED | IN | 0 | N/A | |
| | | OUT | 4 | STATUS (see above) | |
| V | QUERY VERSION | OUT | 4 | STATUS (see above) | See Command S |
| | | | 8 | VERSION STRING | |
| C | SET LOCAL CLOCK | IN | 10 | 10 DIGITS (0.1 sec) | |
| | | OUT | 4 | STATUS (see above) | |
| c | GET LOCAL CLOCK | OUT | 4 | STATUS (see above) | See Command S. |
| | | | 10 | 10 DIGITS (0.1 sec), | Echos clock value. Can be used to confirm bi-directional communication. |

What is claimed is:

1. A training apparatus for a howitzer gun aiming device, which aiming device includes a pantel capable of viewing a sight picture of a distant collimator for alignment of the pantel with the collimator, a pantel deflection setting means for setting a pantel deflection and a gun deflection, a pantel level indicator for indicating a pantel level, a quadrant setting means for setting a quadrant and a gun elevation, and a quadrant level indicator for indicating a level of the quadrant, comprising:

(1) a video means which is manually removably attachable to the pantel for receiving the sight picture in the pantel or for displaying a synthetic sight picture in a pantel eyepiece;

(2) a pantel deflection setting encoder which is manually removably attachable to the pantel deflection setting means for encoding signals responsive to a pantel deflection setting;

(3) a pantel level encoder which is manually removably attachable to the pantel for encoding signals responsive to a pantel level;

(4) a quadrant setting encoder which is manually removably attachable to the quadrant setting means for encoding signals responsive to a quadrant setting;

(5) a quadrant level encoder which is manually removably attachable to the quadrant for encoding signals responsive to a quadrant level; and (6) a data processing computer for receiving and analyzing the sight picture, or for displaying and controlling the synthetic sight picture in the pantel eyepiece, and for receiving the signals and evaluating the alignment, settings and levels.

2. The apparatus of claim 1 wherein the video means receives a sight picture having an image in the pantel and the video means has an optical beam splitter for splitting the image in the pantel into two image beams with one image beam being directed to an eyepiece of the video means and one image beam being directed to a lens of a video camera.

3. The apparatus of claim 2 wherein the beam splitter is in close proximity to the eyepiece.

4. The apparatus of claim 2 wherein the video camera is a computer controlled camera and a collimator image can be displayed more brightly than background images.

5. The apparatus of claim 2 wherein the image in the pantel has a reticle and a collimator picture of the collimator has a reticle and alignment of the gun is achievable by aligning the reticles.

6. The apparatus of claim 5 wherein the computer is capable of comparing the reticle of the collimator picture with the reticle of the pantel so as to determine the accuracy of the alignment.

7. The apparatus of claim 1 wherein the pantel deflection setting encoder is attachable to a pantel deflection setting input device.

8. The apparatus of claim 7 wherein pantel deflection setting encoder has a pantel deflection setting input device which is substantially the same as the pantel deflection setting input device, so that an operation of the encoder input device is substantially the same as an operation of the setting input device.

9. The apparatus of claim 1, wherein the pantel level encoder is an inclinometer.

10. The apparatus of claim 9, wherein the inclinometer is capable of determining the level and a cross-level of the pantel.

11. The apparatus of claim 10, wherein the inclinometer is a two-axis electrolytic tilt sensor.

12. The apparatus of claim 1, wherein the quadrant setting encoder is attachable to a quadrant setting input device.

13. The apparatus of claim 12, wherein the quadrant setting encoder has a quadrant setting input device which is substantially the same as the quadrant setting input device, so that an operation of the encoder input device is substantially the same as an operation of the setting input device.

14. The apparatus of claim 1 wherein the quadrant level encoder is an inclinometer.

15. The apparatus of claim 14, wherein the inclinometer is capable of determining the level and a cross-level of the quadrant.

16. The apparatus of claim 15, wherein the inclinometer is a two-axis electrolytic tilt sensor.

17. The apparatus of claim 1, wherein the computer is capable of communicating with a distant read-out device such that an evaluation of the alignment, settings and levels may be made at a distance from the computer.

18. The apparatus of claim 17, wherein the read-out device is a computer.

19. The apparatus of claim 1, wherein the video means displays a sight picture and the video means includes a video monitor for displaying a synthetic video sight picture of a collimator and background thereof in an eyepiece of the video means.

20. The apparatus of claim 19, wherein an encoder detects motion of the gun turret.

21. The apparatus of claim 1 wherein the video means, pantel deflection setting encoder, pantel level encoder, quadrant setting encoder and quadrant level encoder are enclosable in and hand carryable with a hand carrying case.

22. A training method for remotely and substantially instantaneously evaluating the aiming alignment, settings and levels set by a crew training on a howitzer gun, comprising:

(1) manually removably attaching to a pantel of the gun a video means for receiving a sight picture in the pantel or for displaying a synthetic sight picture in a pantel eyepiece;

(2) manually removably attaching to a pantel deflection setting means a pantel deflection setting encoder for encoding signals responsive to a pantel deflection setting;

(3) manually removably attaching to the pantel a pantel level encoder for encoding signals responsive to a pantel level;

(4) manually removably attaching to a quadrant setting means a quadrant setting encoder for encoding signals responsive to a quadrant setting;

(5) manually removably attaching to a quadrant a quadrant level encoder for encoding signals responsive to a quadrant level; and (6) receiving in a data processing computer said sight picture, or the data processing computer displaying and controlling the synthetic sight picture in a pantel eyepiece, and receiving in the data processing computer said signals for evaluation of the alignment, settings and levels.

* * * * *